United States Patent [19]

Buchner et al.

[11] Patent Number: 4,511,538

[45] Date of Patent: Apr. 16, 1985

[54] APPARATUS FOR STERILIZING PACKAGING CONTAINERS

[75] Inventors: Norbert Buchner, Winnenden; Günther Vögele, Schönaich, both of Fed. Rep. of Germany

[73] Assignee: Robert Bosch GmbH, Stuttgart, Fed. Rep. of Germany

[21] Appl. No.: 426,330

[22] Filed: Sep. 29, 1982

[30] Foreign Application Priority Data

Dec. 17, 1981 [DE] Fed. Rep. of Germany ..... 3150035

[51] Int. Cl.[3] ..... A61L 2/20; G05D 7/00

[52] U.S. Cl. ..... 422/303; 422/29; 422/115; 422/302

[58] Field of Search ..... 422/29, 31, 115, 302, 422/303, 304

[56] References Cited

U.S. PATENT DOCUMENTS

| | | | |
|---|---|---|---|
| 1,954,222 | 4/1934 | Olson | 422/303 X |
| 2,014,750 | 9/1935 | Stegemann | 422/304 X |
| 2,501,193 | 3/1950 | Schulte | 422/303 |
| 3,688,783 | 9/1972 | Owens | 422/303 X |
| 3,723,060 | 3/1973 | Lisiecki | 422/302 X |
| 4,296,068 | 10/1981 | Hoshino | 422/304 X |
| 4,424,189 | 1/1984 | Hick | 422/29 X |

FOREIGN PATENT DOCUMENTS

| | | | |
|---|---|---|---|
| 2611173 | 9/1977 | Fed. Rep. of Germany | 422/31 |

*Primary Examiner*—Barry S. Richman
*Assistant Examiner*—Brion P. Heaney
*Attorney, Agent, or Firm*—Edwin E. Greigg

[57] ABSTRACT

A sterilizing apparatus for packaging containers is equipped with a preparation apparatus for a mixture of hot air and sterilizing agent vapor and a closable sterilizing chamber, into which containers to be sterilized are introduced. The closure means for the sterilizing chamber includes means for suspending a container to be sterilized within the sterilizing chamber. In order to realize a reduced use of sterilizing agent and heating energy, the apparatus has a circulatory system of mixture supply. The sterilizing chamber, as well as a bypass parallel to it, forms a part of this circulatory system. The bypass and the sterilizing chamber are alternately connected with the circulatory system by means of a reversing valve during nonsterilizing and sterilizing periods. A circulating blower, an air heater, and a preparation apparatus are also part of the circulatory system.

4 Claims, 2 Drawing Figures

APPARATUS FOR STERILIZING PACKAGING CONTAINERS

BACKGROUND OF THE INVENTION

The invention is based on an apparatus for the sterilization of packaging containers. For example, in an apparatus known from German Offenlegungsschrift 25 09 611, a mixture of hot air and hydrogen peroxide steam is blown into a chamber into which the articles to be sterilized such as jars are introduced. Peroxide condenses on the comparatively cold walls of the containers and develops its sterilizing power there. At the successive stations the condensed peroxide is rinsed off with hot air. The exhaust air, enriched with peroxide, and the hot air-peroxide mixture flowing from the chamber are guided through filters to the outside. Apart from the fact that in the known apparatus the mixture of hot air and peroxide is not free of peroxide droplets, which cannot be completely removed by rinsing after they have settled on the walls of the containers and therefore come into contact with the material with which the containers are filled, the known apparatus has the disadvantage of a large consumption of the sterilizing agent and of hot air. This results in a considerable use of energy and in undesirable irritation to the personnel in the work area, if the filters are not working correctly. For these reasons a sterilizing apparatus with low consumption of sterilizing agent and hot air is desirable.

OBJECT AND SUMMARY OF THE INVENTION

The problem discussed in the foregoing section is solved in a simple way with a sterilizing apparatus in accordance with the present invention. Because the mixture of hot air and sterilizing agent is continuously moving in a closed cycle, the expenditure of heating energy and sterilizing agent is tailored to the actual consumption. Irritation to the personnel is kept to a minimum. Because the hot air is evenly charged with the evaporated sterilizing agent, the mixture is prepared optimally without containing droplets of sterilizing agent.

Advantageous developments and refinements of the sterilizing apparatus described are possible by means of the steps described herein. As set forth herein, it is shown to achieve an aimed-for guidance of the mixture of hot air and evaporated sterilizing agent in the area of the containers to be sterilized, leading to an even condensation of the sterilizing agent on the walls of the containers placed into the chamber. The apparatus is developed for an exceptionally high rate of production, since at the time of the opening of the switching valve the correct mixture flows into the containers and along their walls without being directed elsewhere.

The invention will be better understood and further objects and advantages thereof will become more apparent from the ensuing detailed description of a preferred embodiment taken in conjunction with the drawings.

BRIEF DESCRIPTION OF THE DRAWINGS

An exemplary embodiment of the present invention is shown in the drawing and explained in greater detail in the ensuing description.

DESCRIPTION OF A PREFERRED EMBODIMENT

Figure 1:
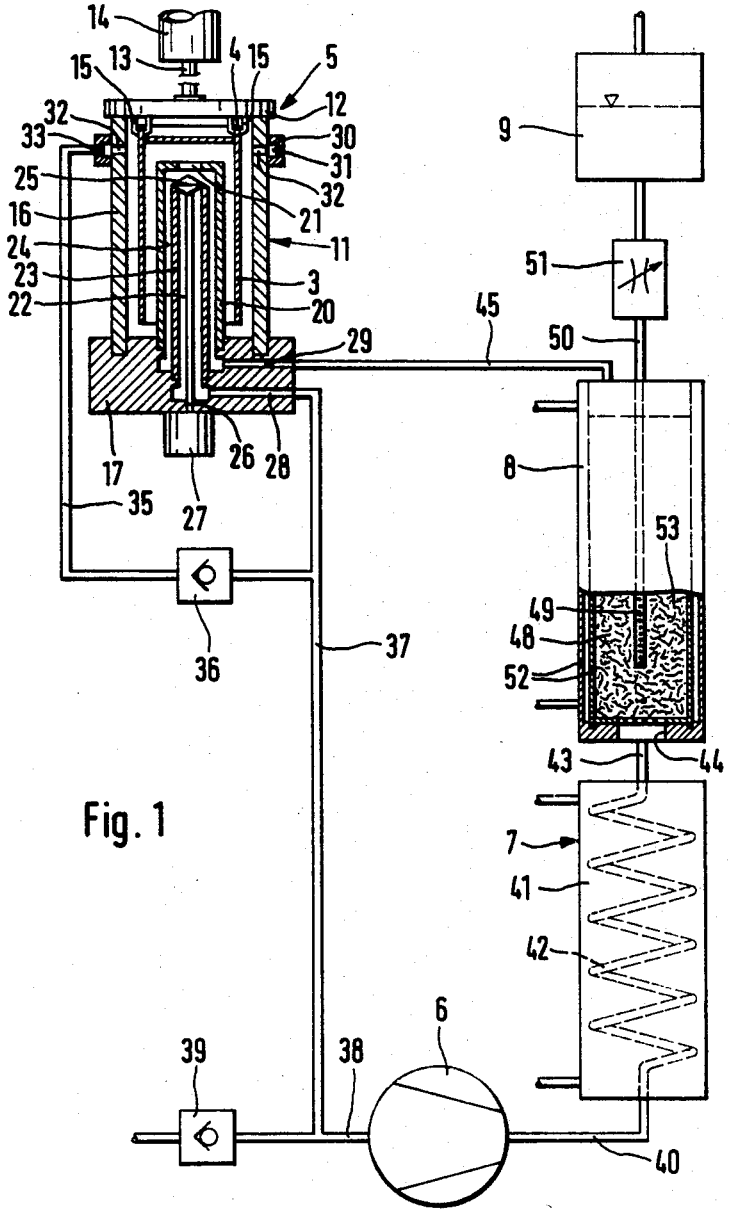
FIG. 1 shows a partial sectional view of a sterilizing apparatus for jar-like containers.

The sterilizng apparatus for jar-like packaging containers 3 consists of a sterilizing chamber 6, a circulating blower 6, an air heater 7, a preparation apparatus 8 for a mixture of hot air and sterilizing agent and a supply tank 9 for a sterilizing agent.

The sterilizing chamber 6 is mainly formed by a stationary receptacle 11, open at the top with a removable lid 12. The lid 12 is fastened to a piston rod 13 of a pneumatic work cylinder 14, by which it can be raised and lowered. It is provided with holding clamps 15 on its underside for the clamping of a container 3, to be sterilized, by its edge protruding from its bottom. The receptacle part 11 is composed of a casing 16 and a bottom part 17. A nozzle 20 with an upper outlet 21 extends into the receptacle part 11 coaxial therewith from the bottom part 17. The nozzle 20 partially fills the interior of the container 3 to be sterilized so that a small, even space remains between the inner walls of a container 3, inserted into the receptacle part 11 with the lid 12, and the outer circumference of the nozzle 20. The height of the casing 16 of the receptacle part 11 is calculated in such a way that the open end of the container 3, held by its bottom edge 4 by the closed lid 12, is spaced from the bottom part 17 by a distance corresponding to the spacing between the nozzle 20 and the container to be sterilized.

On the same axis within the nozzle 20 is a pipe connector 23, which is also incorporated into the bottom paert 17. This pipe connector 23 surrounds an inner discharge conduit 22 and, on the outside and together with the interior of the nozzle 20, limits an annular supply passage 24. Between the upper outlet 21 of the nozzle 20 and the upper end of the pipe connector 23 a double-cone valve body 25 is movably disposed, closing in its upper position the outlet 21 of the nozzle 20 and in its lower position the pipe connector 23. The valve body 25 is moved up and down by a pneumatic work cylinder 27 via a rod 26.

The discharge conduit 22 of the pipe connector 23 ends with its lower end connecting with a lateral bore 28, and the supply passage 24 formed between the pipe connector 23 and the nozzle 20 is connected with a lateral bore 29 in the bottom part 17 which parallels lateral bore 28. The casing 16 of the receptacle part 11 is surrounded near its upper end by a ring 30 with an annular groove 31. A plurality of openings 32 in the casing 16 and an opening 33 in the ring 30 connect the interior of the receptacle part 11 with a line 35 via the annular groove 31. This line 35 leads, via a back-pressure valve 36 and a line 37, connected with the lateral bore 28 in the bottom part, to the aspirating side of the circulating blower 6. A line 38 also leads to this aspirating side via a back-pressure valve 39.

On the pressure side, the circulating blower 6 is connected via a line 40 with the air heater 7, which has a steam-heated tank 41 and a heat-exchange coil 42. The heat-exchange coil 42, which conducts air, is connected with the inlet 44 of the preparation apparatus 8 via a line 43, and the outlet of the preparation apparatus 8 is connected via a line 45 with the lateral bore 29 in the bottom part 17.

The preparation apparatus 8, used for the generation of the mixture of hot air and evaporated sterilizing agent for the sterilizing of the containers 3, is constructed in the form of an exchange column. It has a cylindrical chamber 48 with a fill 53 of filter material or chips or the like, into which extends from above a perforated pipe 49, which is connected via a line 50 and an adjustable throttle valve 51 with the pressurized supply tank 9. The chamber 48 is surrounded by a steam-heated double casing 52. The line 45 is connected to the upper end of the chamber 48.

The apparatus described above operates in the following manner: In order to prepare the mixture of hot air and sterilizing agent vapor used for the sterilization of the packaging containers 3 in the sterilizing chamber 5, the circulating blower 6 blows ambient air from the sterilizing chamber 5 and fresh air aspirated via the line 38 and the back-pressure valve 39 through the air heater 7 and the preparation apparatus 8. The air is heated in the air heater to about 125° C., it is admitted to the inside of the preparation apparatus 8 from below the filter, then flows through the filter material in the chamber 48. In this process, it absorbs sterilizing agent evaporated by the heat, preferably hydrogen peroxide of a strength of 35%, up to an amount just below the saturation limit. The peroxide liquid is supplied to the filter material at room temperature by means of the adjustable pressure generated in the head-room of the supply tank 9 through the adjustable throttle valve 51, via the pipe 49, in measured doses and distributed in the filter material through perforations in the pipe 49. The hot air containing the peroxide vapor flows through the line 45, the lateral bore 29 and the supply passage 24 in the nozzle 20 in the sterilizing chamber 5.

Figure 2:
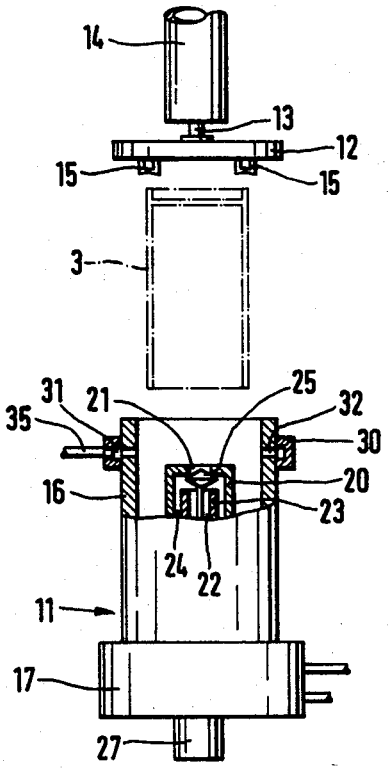
FIG. 2 shows a sterilizing chamber of the apparatus in the loading-unloading position.

A container 3 to be sterilized is introduced with its open end down, together with the lid 12, into the receptacle part 11 and the top is sealed. The work cylinder 27 pulls the valve body 35 into the lower position, thus closing the pipe connector 23, and opens the outlet 21 of the nozzle 20 (FIG. 1). The mixture of hot air and peroxide vapor passes through opening 21 and blows against the bottom of the container 3 because of the positive pressure. The mixture is redirected by the end of the jar, then flows downwardly in the annular spaced between the nozzle 20 and the interior wall of the container surface. From there the mixture flows around the edge of the container 3 upwardly between the outside wall of the container surface and the inside of the casing 16 and flows through openings 32 in the receptacle part 11 into the annular groove 31 and from there, through the line 35, valve 36, lines 37 and 38 to the aspirating side of the circulating blower 6. While flowing along the walls of the containers 3 suspended in the sterilizing chamber 5, which are at normal room temperature, the peroxide condenses out of the mixture onto the inner and outer wall surfaces of the jar in the form of a thin liquid film. The peroxide is evenly distributed over the wall surfaces without the formation of droplets, which has an intensely sterilizing effect so that the desired sterility is achieved within a treatment period of from about 1.5 to about 3 seconds. After this time, the valve body 25 is moved to its upper position, thus closing again the outlet 21 of the nozzle 20 and opening the end of the pipe connector 23 (FIG. 2). In this position of the valve body 36, the mixture flows from the interior of the nozzle 20 into the discharge conduit 22 of the pipe connector 23 and through it and the lateral bore 28, as well as the lines 37 and 38 back to the aspirating side of the circulating blower 6. Because of the process described above and by means of the valve body 25, forming a reversing valve together with the pipe connector 23 and the outlet 21 of the nozzle 20, the mixture of hot air and peroxide vapor is kept in a continuous circulating motion during the sterilizing phase as well as in the interval during which the sterilizing chamber 5 is loaded and emptied. The sterilizing chamber 5 herein forms a part of the main circuit, and parallel with it, the discharge conduit 22 in the pipe connector 23 and the lateral bore 28 form a bypass.

After the mixture supplied to the sterilizing chamber 5 is stopped, the chamber is left closed for about 3 seconds longer, in order to let the peroxide work. Another possibility would be to open the chamber and to let the peroxide condensate continue to act on the open package. In this way the peroxide evaporates more easily. After the chosen time period has elapsed, the lid 12 is lifted upwards, and the container 3 is lifted therewith. The condensed peroxide starts to evaporate immediately subsequent to the treatment period because of the warming of the container walls by the heat generated in the sterilizing chamber 5. The remaining small amount of peroxide dries completely with the opening of the sterilization chamber 5. Any peroxide traces remaining on the jar surfaces after removal from the treating process can be dried later by blowing hot air over the surfaces.

After blow drying, if necessary, the sterlized dry container 3 is immediately moved to the filling and sealing positions. These procedures take place in a room kept sterilized and in which the sterilizing chamber 5 is also disposed.

The exemplary embodiment shown and described illustrates only one sterilizing chamber 5. In order to increase efficiency, embodiments are possible within the scope of the invention in which several containers or parts of containers could be simultaneously sterilized and which have for this purpose several sterilizing chambers supplied by a single mixture preparation apparatus or have several nozzles and reversing valves in a single sterilizing chamber.

In cases where the outside of the containers is not to be sterilized, the openings 32, forming the outlet of the sterilizing chamber, and the collector ring 30 are disposed at the lower end of the casing 16 of the receptacle part 11, near the bottom part.

If the outside of the bottom of the container 3 is to be rinsed especially thoroughly it is also possible to dispose the outlet for the mixture in a central location in the lid of the sterilizing chamber.

The packaging container can, of course, be upright, i.e., the receptacle of the sterilizing chamber can be turned 180°. The blower and the supply and discharge circuits could then be connected with a movable part, also to the side walls of the bell-shaped receptacle.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for sterilizing packaging containers which comprises: a closable chamber, a closure means for closing said closable chamber, said closure means including means for suspending a container to be sterilized within said chamber, means for the preparation of a sterilizing mixture of hot air and sterilizing agent vapor, means for directing said mixture into said closable chamber containing at least one container, wherein said mixture is directed into said container along a linear axis, passes along the inner wall of said container and then along the outside of said container, a reversing valve means within said chamber for admitting a circulation of said sterilizing mixture into said container during sterilization thereof and for directing said sterilization mixture back to said means for preparation of said mixture during the open state of the chamber.

2. An apparatus in accordance with claim 1 further comprising a nozzle disposed in said chamber wherein said nozzle partially fills the inside of the container introduced into said chamber while leaving a space between said container and said nozzle.

3. An apparatus in accordance with claim 2 wherein said reversing valve is disposed in said nozzle.

4. An apparatus in accordance with claim 3 further comprising a pipe connector surrounded by said nozzle, and forming with said nozzle a supply passage, wherein said reversing valve means is moveable from one end of said pipe connector to an outlet in said nozzle, said pipe connector forming a discharge conduit whereby said reversing valve is capable of closing said discharge conduit when said container is being sterilized and opening said discharge conduit while closing said nozzle outlet when said closable chamber is open and when said container is not being sterilized.

* * * * *